US008171573B2

(12) United States Patent
Chun et al.

(10) Patent No.: US 8,171,573 B2
(45) Date of Patent: May 8, 2012

(54) FUNCTIONAL CLOTHING ARTICLES AND WAIST SUPPORTS

(75) Inventors: Nancy Dokyong Chun, La Mirada, CA (US); Stepano Youngil Chun, La Miranda, CA (US)

(73) Assignee: A-C Medical Supply Corporation, Santa Fe Springs, CA (US)

( * ) Notice: Subject to any disclaimer, the term of this patent is extended or adjusted under 35 U.S.C. 154(b) by 1890 days.

(21) Appl. No.: 11/249,391

(22) Filed: Oct. 14, 2005

(65) Prior Publication Data

US 2007/0094775 A1 May 3, 2007

(51) Int. Cl.
*A41D 13/00* (2006.01)

(52) U.S. Cl. ..... 2/465

(58) Field of Classification Search ..... 2/455, 465, 2/79, 227, 69; 128/96.1, 99.1, 100.1, 101.1; 450/122–124, 130, 131, 155
See application file for complete search history.

(56) References Cited

U.S. PATENT DOCUMENTS

| | | | | |
|---|---|---|---|---|
| 1,599,688 | A | 9/1926 | Sullivan | |
| 2,249,198 | A | 7/1941 | Carter | |
| 2,481,396 | A | 9/1949 | Cohen | |
| 2,553,353 | A | 5/1951 | Binder | |
| 2,641,258 | A | 6/1953 | Rutledge | |
| 2,735,100 | A * | 2/1956 | Erteszek | 450/118 |
| 2,910,984 | A | 11/1959 | Yeakey et al. | |
| 2,942,605 | A * | 6/1960 | Erteszek | 450/123 |
| 3,029,814 | A | 4/1962 | Kravitz | |
| 3,116,735 | A | 1/1964 | Geimer | |
| 3,141,457 | A | 7/1964 | Davidson | |
| 3,434,469 | A | 3/1969 | Swift | |
| 3,441,027 | A | 4/1969 | Lehman | |
| 3,454,003 | A | 7/1969 | Sailhen Dit Kelber-Sailhen | |
| 3,526,229 | A | 9/1970 | Blair | |
| 3,554,190 | A | 1/1971 | Kaplan | |
| 3,670,738 | A * | 6/1972 | Johnson | 450/125 |
| 3,683,935 | A * | 8/1972 | Rosner | 450/123 |
| 3,756,247 | A | 9/1973 | Hand | |
| 3,877,439 | A * | 4/1975 | Locascio | 450/123 |
| 3,974,836 | A * | 8/1976 | Carlson | 450/102 |
| 4,108,149 | A * | 8/1978 | Castiglia | 450/155 |
| 4,175,553 | A | 11/1979 | Rosenberg | |
| 4,400,832 | A | 8/1983 | Kinder | |
| 4,475,543 | A | 10/1984 | Brooks et al. | |
| 4,538,615 | A * | 9/1985 | Pundyk | 450/131 |
| 4,572,167 | A | 2/1986 | Brunswick | |
| 4,833,730 | A | 5/1989 | Nelson | |

(Continued)

FOREIGN PATENT DOCUMENTS

EP 0 410 904 A1 1/1991

(Continued)

*Primary Examiner* — Tejash Patel
(74) *Attorney, Agent, or Firm* — Harness, Dickey & Pierce, P.L.C.

(57) ABSTRACT

A functional clothing article may include a body for receiving and supporting a hip region, and a waist region of a user. An abdominal support unit may be provided at a front portion of the body to support the abdominal region. The abdominal support unit may have at least a first abdominal support plate positioned between at least two second abdominal support plates. The elasticity of the at least two second abdominal support plates may be less than the at least one first abdominal support plate. A waist support may be attachable the functional clothing article. The waist support may surround a portion of the user's waist.

22 Claims, 6 Drawing Sheets

U.S. PATENT DOCUMENTS 4,836,194 A 6/1989 Sebastian et al.
4,907,576 A 3/1990 Curlee
4,926,845 A 5/1990 Harris
4,941,237 A 7/1990 Hovis
5,040,524 A 8/1991 Votel et al.
5,086,759 A 2/1992 Buddingh
5,147,261 A 9/1992 Smith et al.
5,148,549 A 9/1992 Sydor
5,182,815 A * 2/1993 Young ..... 2/406
5,188,585 A 2/1993 Peters
5,205,815 A 4/1993 Saunders
5,255,393 A * 10/1993 Brady ..... 2/409
5,334,134 A 8/1994 Saunders
5,399,150 A 3/1995 Saunders
5,465,428 A 11/1995 Earl
5,492,496 A * 2/1996 Walker ..... 450/155
6,023,789 A * 2/2000 Wilson et al. ..... 2/228
2005/0229295 A1 10/2005 Chun et al.

FOREIGN PATENT DOCUMENTS

GB 2 243 787 A 11/1991

* cited by examiner

FUNCTIONAL CLOTHING ARTICLES AND WAIST SUPPORTS

BACKGROUND

1. Field of the Invention

Example embodiments of the present invention relate to functional clothing.

2. Description of the Conventional Art

FIG. 1 illustrates a conventional male girdle. As shown in FIG. 1, the male girdle 10 includes an abdominal band 20 for supporting and protecting a waist, a back, and a lower abdominal region of a user. The male girdle 10 further includes a cavity section 30 for receiving the genitals of the user, and a leg section 40 suitable for receiving legs of the user.

A first connection part 22 is formed at one end of the abdominal band 20. The first connection part 22 has an elastic property for compressing the waist of the user. A second connection part 24 is provided at the free end of the first connection part 22. The second connection part 24 is connected to the first connection part 22 to compress the lower abdominal region of the user. One surface of the second connection part 22 is formed with an adhesive fiber and the other surface of the second connection part 22 is formed with an elastic fiber.

A fourth connection part 26 has an elastic property for compressing the waist of the user. The fourth connection part 26 is formed at the other end of the abdominal band 20. A fifth connection part 28 is provided at the free end of the fourth connection part 26. The fifth connection part 28 is connected to the fourth connection part 26 in order to compress the lower abdominal region of the user. One surface of the fifth connection part 28 is formed with a wool connecting tape and the other surface of the fifth connection part 28 is formed with an elastic fiber.

In conventional clothing articles, such as, a male girdle having the abdominal band, the second connection part 24 is coupled with the fifth connection part 28. The second connection part 24 overlaps the fifth connection part 28, which may tightly compress the abdominal region of the user.

SUMMARY OF THE INVENTION

Example embodiments of the present invention may provide an abdominal stress structure support, while regulating the body temperature of the user's abdomen and/or abdominal region. Example embodiments of the present invention may provide an optional waist muscle protector, which may protect and/or support waist muscles of the user. Example embodiments of the present invention may provide may support the abdominal region, the waist of the user and/or be used for correcting poor posture with less restriction of movement and/or mobility of the user.

An example embodiment of the present invention provides a functional clothing article. The functional clothing article may include a body for receiving and supporting a hip region and a waist region of a user. An abdominal support unit may be provided at a front portion of the body, and may support the abdomen and/or abdominal region of the user. The abdominal support unit may have at least a first abdominal support plate positioned between at least two second abdominal support plates. An elasticity of the two second abdominal support plates may be less than an elasticity of the first abdominal support plate. For example, the two second abdominal support plates may have substantially no elasticity.

Another example embodiment of the present invention provides a functional clothing article. The functional clothing article may include a body for receiving and supporting a hip region, an abdominal region and a waist region of a user. An abdominal support unit may be provided at a front portion of the body and may support the abdomen and/or abdominal region of the user. The abdominal support unit may have at least one first abdominal support plate arranged between and at least two second abdominal support plates. The at least two second abdominal support plates may have loop units (e.g., Velcro loop units) for receiving opposite ends of a waist support.

Another example embodiment of the present invention provides a waist support for attaching to a functional clothing article around the waist of a user. The waist support may include an inner portion including elastic bands and hook units at opposing ends. The hook units may be attachable to the functional clothing article such that the waist support surrounds a portion of the user's waist. The waist support may also include an outer portion covered by the same as a material comprising the body. The waist support may have a length less than that of the users waist.

In example embodiments of the present invention, the abdominal support unit may have a lower portion to support a lower portion of the user's abdominal region. Alternatively, the abdominal support unit may support an upper portion of the abdominal region and a lower portion of the body may have a cavity section for receiving genitals of the user.

In example embodiments of the present invention, the at least one first abdominal support plate and the at least two second abdominal support plates may be comprised of sweat absorptive elastic fibers.

In example embodiments of the present invention, the at least one first abdominal support plate and the at least two second abdominal support plates may be comprised of the same material or different materials. At least one of the first and the at least two second abdominal support plates may include loop units.

In example embodiments of the present invention, a crotch portion may be stitched to the front portion and a rear portion of the body creating two leg holes for receiving the legs of the user. The at least one first abdominal support plate may extend, for example, from a top of the front portion of the body to the crotch portion of the body. In another example, the vertical length of the first abdominal support plate may be less than the vertical length of the at least two second abdominal support plates.

In example embodiments of the present invention, the functional clothing article may further include a waist support having hook units at opposite ends for attaching to the hook units of the at least two second abdominal support plates. The waist support may be attached and may substantially surround the waist region of the user. The opposite ends of the waist support may be non-overlapping.

In example embodiments of the present invention, the waist support may include an inner portion including elastic bands and hook units arranged at opposing ends. The hook units may be attachable to the functional clothing article such that the waist support surrounds a portion of the user's waist. An outer portion covered by a same material the same as a material forming the body. The waist support may have a length less than that of the user's waist.

BRIEF DESCRIPTION OF THE DRAWINGS

Example embodiments of the present invention will be more apparent from the following detailed description of the accompanying drawings, in which.

DETAILED DESCRIPTION OF EXAMPLE EMBODIMENTS OF THE PRESENT INVENTION

Figure 1:
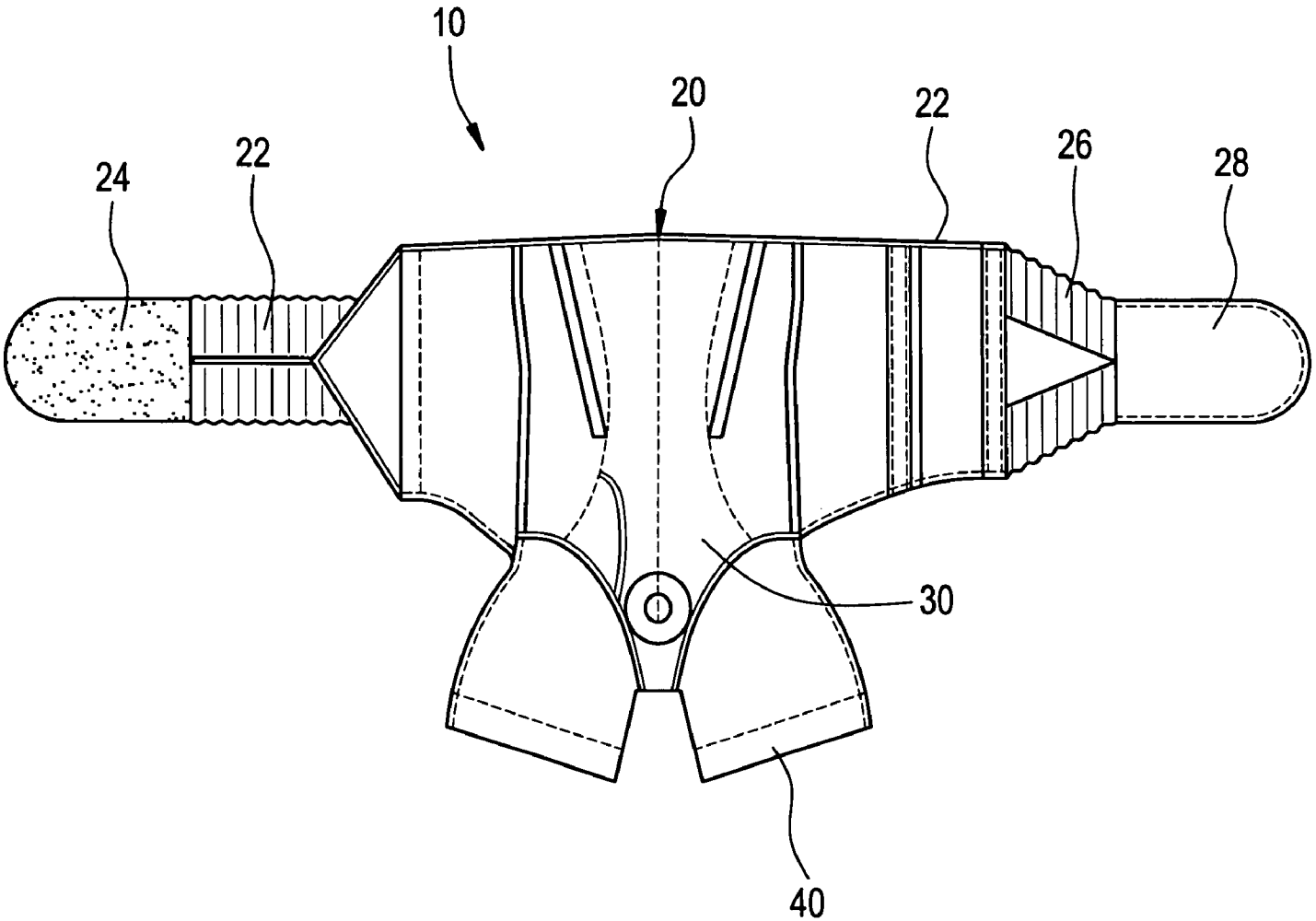
FIG. 1 illustrates a conventional male girdle.
Figure 2A:
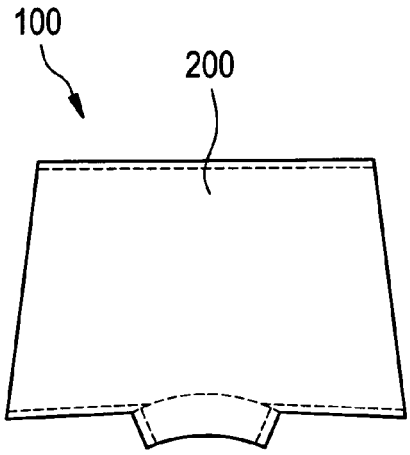
FIG. 2A illustrates a front portion of a body of a functional clothing article according to an example embodiment of the present invention.
Figure 2C:
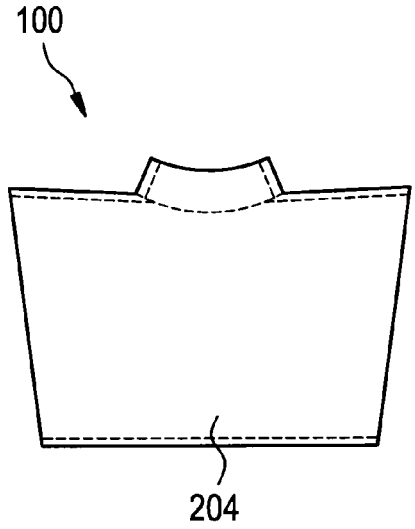
FIG. 2C illustrates a rear portion of a body of a functional clothing article according to an example embodiment of the present invention.
Figure 2B:
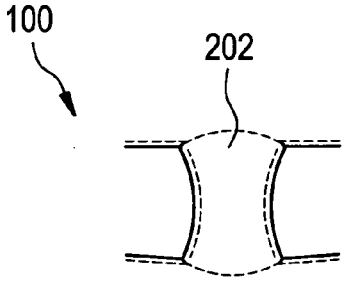
FIG. 2B illustrates a crotch portion of a body of a functional clothing article according to an example embodiment of the present invention.
Figure 3A:
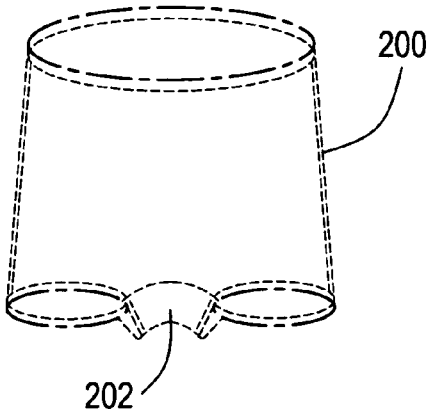
FIG. 3A is a perspective view of a front portion of a body of a functional clothing article according to an example embodiment of the present invention.
Figure 3B:
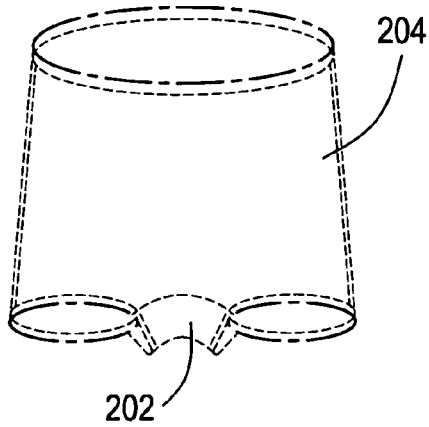
FIG. 3B is a perspective view of a rear portion of a body of a functional clothing article according to an example embodiment of the present invention.

FIG. 2A illustrates a front portion 200 of a body 100 of a functional clothing article according to an example embodiment of the present invention. FIG. 2B illustrates a crotch portion 202 of the body 100 of a functional clothing article according to an example embodiment of the present invention. FIG. 2C illustrates a rear portion 204 of the body 100 of a functional clothing article according to an example embodiment of the present invention. FIGS. 3A and 3B illustrate perspective views of the front portion 200 and rear portion 204, respectively.

The body 100 may be in the form of underwear or an underwear garment. The body 100 may be comprised of cotton, cotton blend, any other suitable synthetic, synthetic blend, natural or natural blend material. When worm, the body 100 may receive and support a hip region, an abdominal region and/or a waist region of the user.

The front portion 200 and the rear portion 204 shown in FIGS. 2A-2C, 3A, and 3B may be comprised of at least two separate pieces of material (e.g., two, three, four, etc.).

The at least two separate pieces may be stitched together creating at least two seams. For example, two edges of two separate pieces of material may be stitched together. The two stitched together edges may be opposing edges and may be comprised of the same, or substantially the same, material. In example embodiments of the present invention, each of the front portion 200 and the rear portion 204 may each be comprised of any suitable number of pieces of material, for example, one, two, three, etc.

In another example, the front portion 200 and rear portion 204 may be comprised of one continuous piece of material. In this example, two opposing edges of the single piece of material may be stitched together forming a cylinder like shape.

The crotch portion 202 may be stitched to the bottom portion of the front and rear portions 200 and 204, respectively. The crotch portion 202 may have an hour glass-type shape, for example, such that when stitched to the front and rear portions 200 and 202, two leg-holes may be created. When worm, the leg-holes may receive the legs of the user.

In another example, a third edge of two separate pieces may be stitched together and the leg holes may be cut out. Thus, the body may comprise one piece of material with at least three seams.

Figure 4A:
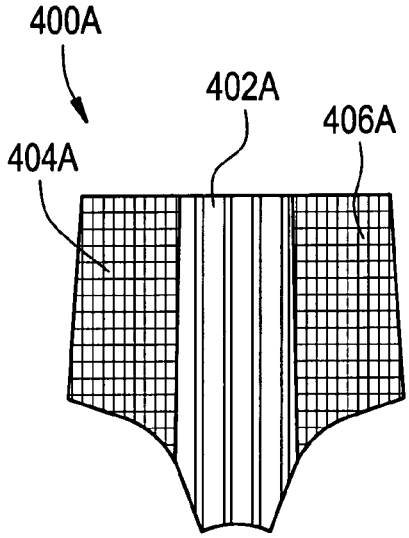
FIG. 4A illustrates an abdominal support unit according to an example embodiment of the present invention.
Figure 4B:
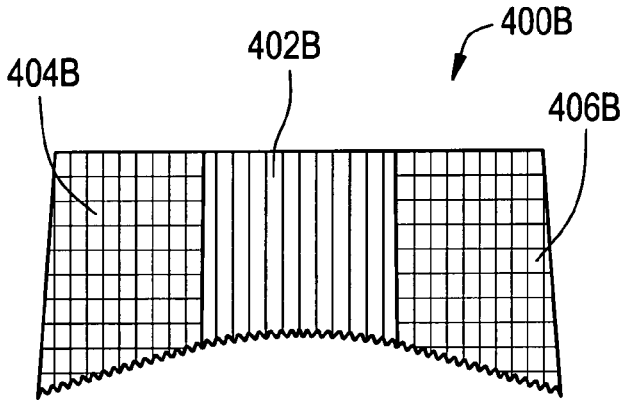
FIG. 4B illustrates an abdominal support unit according to another example embodiment of the present invention.
Figure 5A:
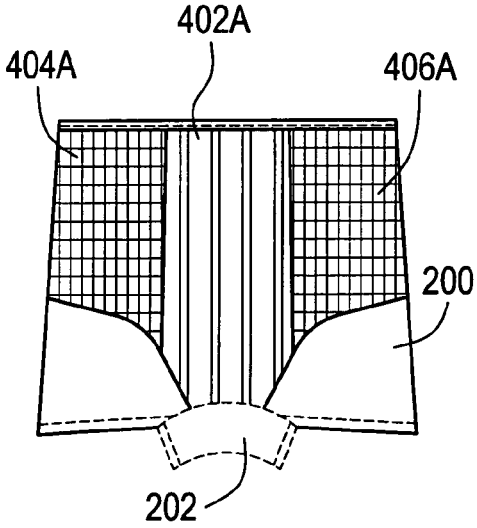
FIG. 5A illustrates a front portion of a functional clothing article according to an example embodiment of the present invention.
Figure 5B:
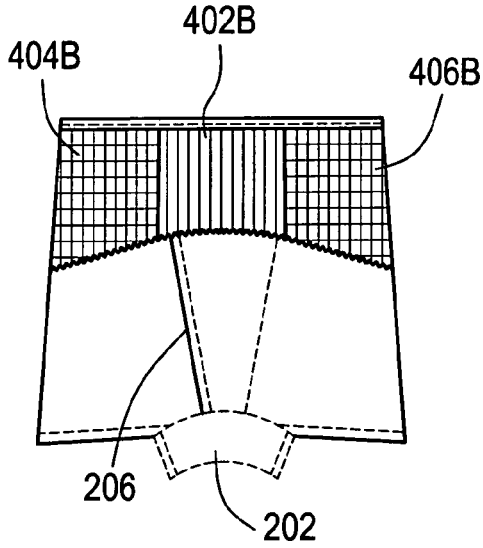
FIG. 5B illustrates a front portion of a function clothing article according to another example embodiment of the present invention.
Figure 6A:
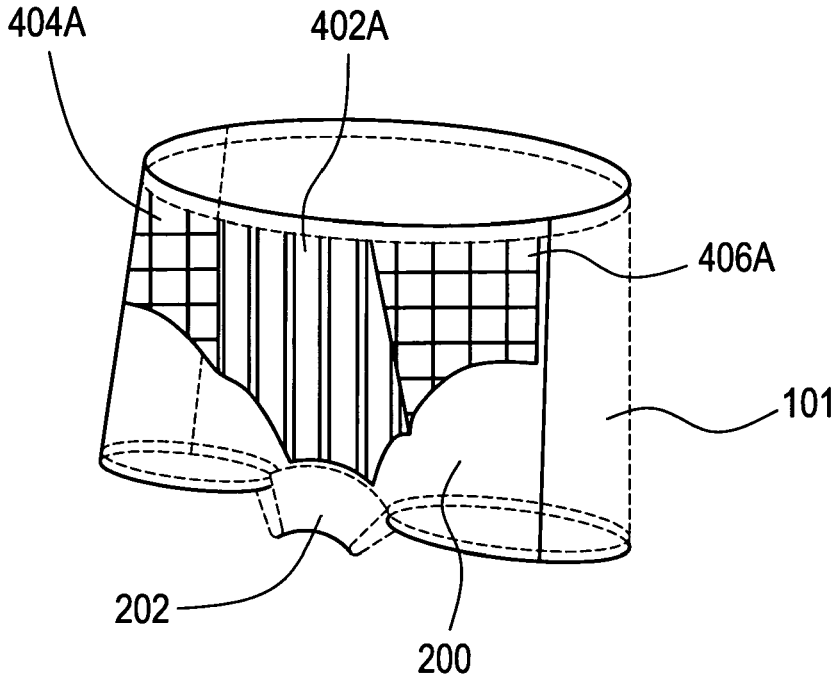
FIG. 6A is a perspective view of the front portion of the functional clothing article illustrated in FIG. 4A.
Figure 6B:
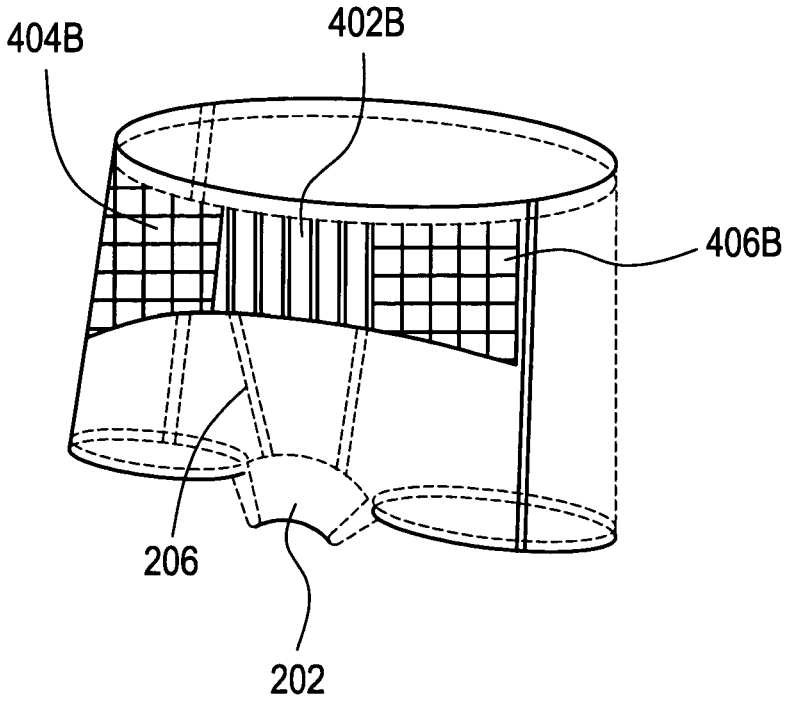
FIG. 6B is a perspective view of the front portion of the functional clothing article illustrated in FIG. 4B.

FIG. 4A illustrates an abdominal support unit according to an example embodiment of the present invention. FIG. 4B illustrates an abdominal support unit according to another example embodiment of the present invention. FIGS. 5A and 5B illustrate the front portion of the body of a functional clothing article including an abdominal support unit according to an example embodiment of the present invention. FIGS. 6A and 6B are perspective views of a front portion of the functional clothing article corresponding to FIGS. 5A and 5B, respectively.

As shown in FIGS. 5A and 5B, the abdominal support units 400A and 400B may be arranged on the front portion 200 of the body 100. The abdominal support units 400A and 400B may span at least a portion of the user's waist.

Referring to FIGS. 4A and 5A, the abdominal support unit 400A may include at least one first abdominal support plate 402A and at least two second abdominal support plates 404A and 406A. The first abdominal support plate 402A may be positioned between the two second abdominal support plates 404A and 406A, such that the abdominal support unit 400A is symmetrical with respect to a vertical axis. The vertical axis may be horizontally centered on the first abdominal support plate 402A and extends from the top edge to the bottom edge of the abdominal support unit 400A. The abdominal support unit 400A may be relatively inflexible.

In one example, the first abdominal support plate 402A may be fabricated using more elastic materials such as wool, a wool-type blend, a similar fabric, Spandex Loop, Lycra Loop, a material having sweat absorptive elastic fibers or any other similar material or blend of materials. The second abdominal support plates 404A and 406A may be fabricated using a wool fiber. The wool fibers may be fabricated such that the second abdominal support plates 404A and 406A include loop units (e.g., Velcro loop units, or any other suitable loop unit). These loop units may be capable of receiving and attaching (e.g., hooking, temporarily securing, etc) hook units (e.g., Velcro hook units) of a waist support (illustrated in FIGS. 7A-7C). The first abdominal support plate 402A may also have loop units suitable for receiving and attaching (e.g., hooking, temporarily securing, etc) hook units of the waist support. The hook units of the waist support may be attached to any portion of the abdominal support unit 400A. The second abdominal support plates 404A and 406A may be less elastic than the first abdominal support plate 402A. For example, the second abdominal support plates 404A and 406A may be inelastic or substantially inelastic. That is, for example, the second abdominal support plates 404A and 406A may have no, or substantially no elasticity.

In another example, the first abdominal support plate 402A and the second abdominal support plates 404A and 406A may be comprised of the same material. In this example, the material comprising the second abdominal support plates 404A and 406A may be more tightly woven than the same material comprising the first abdominal support plate 402A. Thus, the first abdominal support plate 402A and the second abdominal support plates 404A and 406A may be comprised of the same material and the first abdominal support plate 402A may be more elastic (e.g., have a higher elasticity) than the second abdominal support plates 404A and 406A.

The abdominal support unit 400A may have a size sufficient to extend from opposing vertical seams of the front portion 200. Alternatively, the abdominal support unit 400A may have a size sufficient to extend from one side of the user to the other. However, example embodiments of the present invention do not limit the shape and/or size of the abdominal support unit 400A.

As shown in FIG. 5A, the first abdominal support plate 402A may extend from the top edge of the front portion 200 to the crotch portion 202, which may effectively support a lower abdominal region of the user. The first abdominal support plate 402A may be horizontally centered on the front portion 200. The second abdominal support plates 404A and 406A may be positioned on a respective lateral side of the first abdominal support plate 402A, such that the abdominal support plate 400A is vertically symmetrical as discussed above. The second abdominal support plates 404A and 406A may be designed such that they extend vertically from the top edge of the front portion 200 to at least midway (e.g., halfway) between the top edge and the bottom edge of the front portion 200. A bottom edge of the second abdominal support plates 404A and 406A may be curved such that the second abdominal support plates 404A and 406A meet the first abdominal support plate 402A at about three-quarters-way between the top edge and the bottom edge of the front portion 200. The bottom edge of the first abdominal support plate 402A may also be curved such that the bottom of the abdominal support unit 400A has curves on each side, the edge of which extends to the edge of the crotch portion 202.

Referring to FIG. 4B, an abdominal support unit 400B may include at least one first abdominal support plate 402B and at least two second abdominal support plates 404B and 406B. The first abdominal support plate 402B and the second abdominal support plates 404B and 406B of the abdominal support unit 400B may be similar to the first abdominal support plate 402A and the second abdominal support plates 404A and 406A, respectively, except for their respective shapes.

The abdominal support unit plate 402B does not include a lower portion 408A, and has a shorter vertical length relative to the first abdominal support plate 402A. The first abdominal support plate 402A may be horizontally and/or vertically centered on the front portion 200 of the body 100.

For example, the first abdominal support plate 402B may extend vertically from the top edge of the front portion 200 to, at most, midway between the top edge of the front portion 200 and the crotch portion 202. The first abdominal support plate 402B may have a lower edge, which is upwardly concave.

The second abdominal support plates 404B and 406B may be designed such that they extend vertically from the top edge of the front portion 200 to about midway between the top edge and the bottom edge of the front portion 200, and are longer in vertical length than the first abdominal support plate 402B. A bottom edge of the second abdominal support plates 404B and 406B may be curved such that the bottom edge of the second abdominal support plates 404B and 406B meet the bottom edge of the first abdominal support plate 402B at less than midway between the top edge and bottom edge of the front portion 200.

The bottom edges of the first abdominal support plate 402B and the second abdominal support plates 404B and 406B may be shaped such that the bottom edge of the abdominal support unit 400B is upwardly concave.

Referring still to FIG. 5B, the front portion 200 may include a cavity section 206 in order to receive genitals of a male user. The cavity section 206 may replace a lower portion of the abdominal support plate 402A, and may extend from the bottom edge of the first abdominal support plate 402B to the crotch portion 202. The cavity section 206 may have an inverted triangle-type shape, as shown in FIG. 5B.

At least edges of the abdominal support units 400A and 400B may be stitched to the front portion 200. An inner portion of the abdominal support units 400A or 400B may also be stitched to the front portion 200 of the body 100 to provide additional stitch strength. This may secure the abdominal support units 400A or 400B to the body 100. The stitching may have a double stitch structure so as to elastically support the lower abdominal region of the user.

Figure 7A:
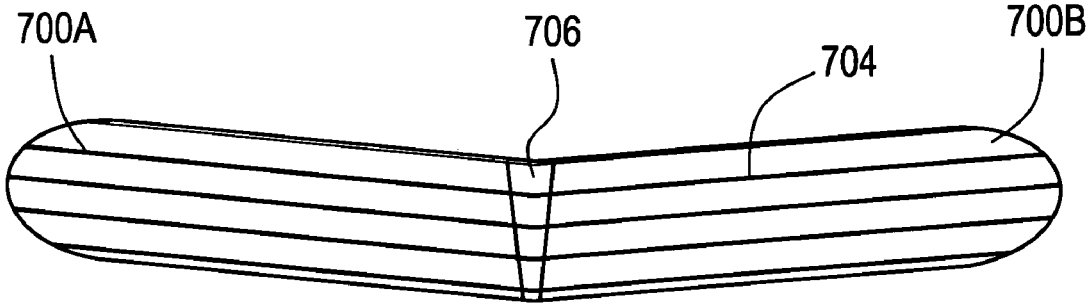
FIGS. 7A-7C illustrate a waist support according to an example embodiment of the present invention.
Figure 7B:
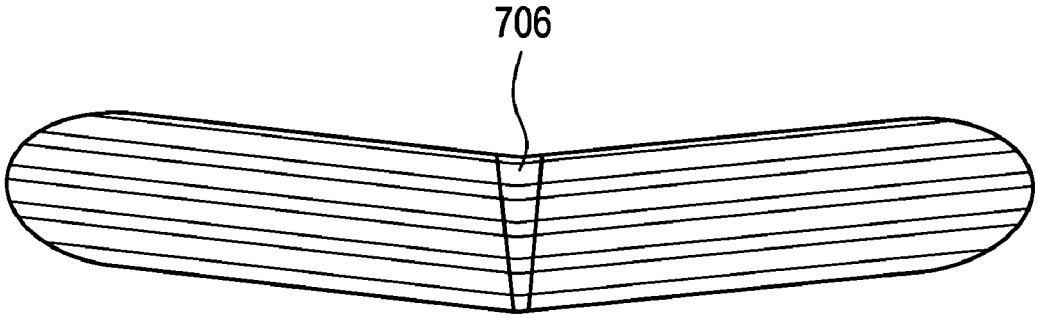
Figure 7C:
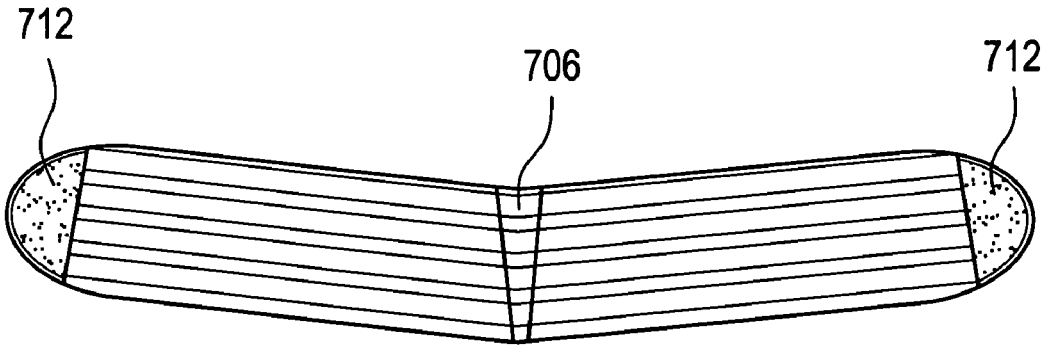

FIGS. 7A-7C illustrate a waist support according to an example embodiment of the present invention. FIG. 7A illustrates an inner portion of the waist support. FIG. 7B illustrates an outer portion of the waist support. As shown in FIG. 7B, the outer portion of the waist support may be covered with a fabric. The fabric may be comprised of the same material as the body 100. FIG. 7C illustrates an inner portion of the waist support according to an example embodiment of the present invention.

Referring to FIG. 7A, the waist support may include two portions 700A and 700B. The two portions 700A and 700B may each include a plurality of elastic bands 704. The elastic bands 704 may extend, for example, transversely between horizontal ends of each portion of the waist support. Each of the first and second portion 700A and 700B may also include at least one hook unit (e.g., Velcro hook unit or any other suitable hook unit) 712 at one end as shown in FIG. 7C. The hook unit(s) 712 may be attachable to the first abdominal support plates 402A, 402B and/or the second abdominal support plates 404A, 406A, 404B and 406B via the loop units (e.g., Velcro loop units) discussed above. As also shown in FIG. 7C the inner portion may be covered in a material. The material may be the same material as that which comprises body 100.

The waist support may be formed by densely stitching together an end of each of the first portion 700A and the second portion 700B. The stitching of ends of portions 700A and 700B is denoted 706 in FIG. 7A. The stitched ends may be ends opposite to ends including the hook unit(s) 712. The two ends of first and second portions 700A and 700B may be stitched together such that the waist support may be angled as shown in FIG. 7A. This angle may allow the waist support to adjust to body contour and/or fit more comfortably on the user. The waist support may be fabricated using a more flexible material than the abdominal support unit 400A or 400B. In example embodiments of the present invention, the waist support may be comprised of cotton, cotton blend, cotton-type material, CoolMax, Moistex, a combination thereof or any other suitable material.

Figure 8A:
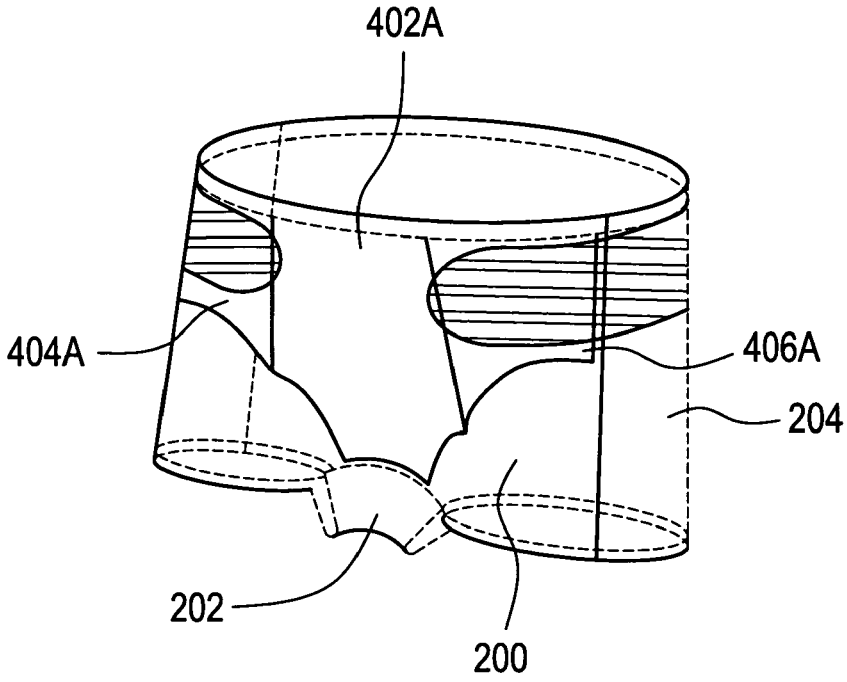
FIGS. 8A and 8B illustrate a functional clothing article in combination with the waist support according to example embodiments of the present invention.
Figure 8B:
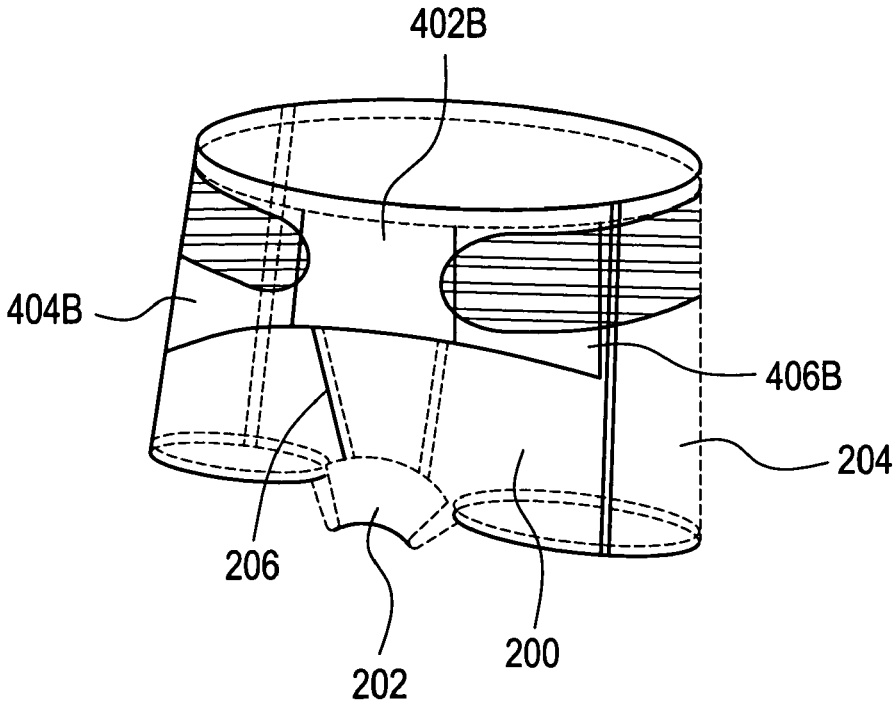

FIGS. 8A and 8B illustrate a functional clothing article in combination with the waist support according to an example embodiment of the present invention. The function clothing article shown in FIG. 8A is the same as that which is illustrated in FIG. 6A. As shown in FIG. 8A, the waist support 700 may surround the user's waist. The stitched ends of the waist support may be positioned adjacent to the rear portion 204 such that the stitching 706 is in vertical alignment with the user's spine. A transverse edge of the waist support may align slightly askew relative to the upper edge of top of the body 100.

For example, the waist support may align about parallel relative to the upper edge of the body 100. The hook unit(s) 712 at each end of the waist support 700 may attach to the abdominal support unit 400A or 400B. For example, each of the hook unit(s) 712 may attach to one of the second abdominal support plates 404A and 406A, respectively.

In another example, each of the hook unit(s) 712 may partially attach to loop units of one of the second abdominal support plates 404A and 406A, respectively, and partially attach to loop units of the first abdominal support plate 402A.

Referring to FIG. 8B, the functional clothing article illustrated in FIG. 8B is that which is illustrated in FIG. 6B. The waist support and functional clothing article of FIG. 8B may be attached (e.g., combined, temporarily secured, etc.) in the same manner as described above with regard to FIG. 8A. Thus, a similar discussion of this attachment will be omitted for the sake of brevity.

The functional clothing article in combination with the waist support, according to example embodiments of the present invention, may provide support to a user's lumbar vertebra and/or sacral region thereby protecting the waist of the user. Example embodiments of the present invention provide support, fit comfortably and/or may adjust to the body's contour and/or shape while allowing freedom of body movement.

In the case of male users, the functional clothing article may support an upper portion of the abdominal region while the cavity section 206 may receive genitals of the user.

In at least one example embodiment of the present invention, the waist support/protector may be attached to any portion of the abdominal support plate to support weak waist muscles of the user.

In at least one example embodiment of the present invention, the abdominal region of the user may not be tightly pressed, and the waist support design provides no rising-up of the waist support/protector.

The waist protector according to at least one example embodiment of the present invention does not attach or couple to the rear portion of the functional clothing article, and may encircle the waist of the user.

At least one example embodiment of the present invention may provide support without limitation of movement and/or allow more mobility of the waist muscle without irritation to the skin. For example, when the user attaches the optional waist support/protector to the abdominal support plate, the semi circle shape of the Velcro hook units are detachable and attach to the abdominal plates without overlapping each other. As a result the users waist is supported while the abdominal region of the wearer is not too tightly compressed.

Although example embodiments of the present invention has been described for illustrative purposes, those skilled in the art will appreciate that various modifications, additions and substitutions are possible, without departing from the scope and spirit of the invention.

What is claimed is:

1. A functional clothing article comprising:

a body for receiving and supporting a hip region and a waist region of a user;

an abdominal support unit provided at a front portion of the body and supporting the abdominal region of the user, the abdominal support unit having at least a first elastic abdominal support panel positioned between at least two second elastic abdominal support panels, an elasticity of the at least two second elastic abdominal support panels being less than an elasticity of the first elastic abdominal support panel; wherein the first elastic abdominal support panel and the at least two second elastic abdominal support panels are positioned laterally about the waist region of the user, and the at least two second elastic abdominal support panels further include loop units.

2. The functional clothing article of claim 1, wherein the abdominal support unit has a lower portion to support a lower portion of the user's abdominal region.

3. The functional clothing article of claim 1, wherein the abdominal support unit supports an upper portion of the abdominal region, and a lower portion of the body has a cavity section for receiving genitals of the user.

4. The function clothing article of claim 1, wherein the first elastic abdominal support panel and the at least two second elastic abdominal support panels are comprised of sweat absorptive elastic fibers.

5. The functional clothing article of claim 1, wherein the first elastic abdominal support panel and the at least two second elastic abdominal support panels are comprised of the same material.

6. The functional clothing article of claim 1, wherein the first elastic abdominal support panel and the at least two second elastic abdominal support panels are comprised of different material.

7. The functional clothing article of claim 1, further comprising:

a crotch portion stitched to the front portion and a rear portion of the body creating two leg holes for receiving the legs of the user; and wherein the first elastic abdominal support panel extends from a top of the front portion of the body to the crotch portion of the body.

8. The functional clothing article of claim 1, wherein a vertical length of the first elastic abdominal support panel is less than the vertical length of the at least two second elastic abdominal support panels.

9. The functional clothing article of claim 1, further comprising:

a waist support having hook units at opposite ends for attaching to the loop units of the at least two second elastic abdominal support panels.

10. The functional clothing article of claim 8, wherein when the waist support is attached, the waist support substantially surrounds the waist region of the user.

11. The functional clothing article of claim 9, wherein when attached the opposite ends of the waist support are non-overlapping.

12. A functional clothing article comprising:

a body for receiving and supporting a hip region and a waist region of a user;

an abdominal support unit provided at a front portion of the body and supporting the abdominal region of the user, the abdominal support unit having at least a first elastic abdominal support panel positioned between at least two second elastic abdominal support panels, an elasticity of the at least two second elastic abdominal support panels being less than an elasticity of the first elastic abdominal support panel, wherein the first elastic abdominal support panel and the at least two second elastic abdominal support panels are positioned laterally about the waist region of the user; and a waist support including, an inner portion including elastic bands and hook units, the hook units being arranged at opposing ends of the waist support, and the hook units being attachable to the functional clothing article such that the waist support surrounds a portion of the user's waist, and an outer portion covered by the first material, wherein the waist support is configured such that the hook units do not overlap when worn around the user's waist.

13. A functional clothing article comprising:

a body for receiving and supporting a hip region, an abdominal region and a waist region of a user;

an abdominal support unit provided at a front portion of the body and supporting the abdominal region of the user, the abdominal support unit having at least one first elastic abdominal support panel and at least two second elastic abdominal support panels, the at least two second elastic abdominal support panels having loop units for receiving opposite ends of a waist support; wherein the at least one first elastic abdominal support panel is arranged between the at least two second elastic abdominal support panels, and the at least one first elastic abdominal support panel and the at least two second elastic abdominal support panels are positioned laterally about the waist region of the user.

14. The functional clothing article of claim 13, wherein the at least two second elastic abdominal support panels and the at least one first elastic abdominal support panels are comprised of the same material.

15. The functional clothing article of claim 13, wherein the at least two second elastic abdominal support panels and the at least one first elastic abdominal support panels are comprised of different material.

16. The functional clothing article of claim 13, further comprising:

a crotch portion stitched to the front portion and a rear portion of the body creating two leg holes for receiving the legs of the user; and wherein the at least one first elastic abdominal support panel extends from a top of the front portion of the body to the crotch portion of the body.

17. The functional clothing article of claim 13, wherein a vertical length of the at least one first elastic abdominal support panel is less than the vertical length of the at least two second elastic abdominal support panels.

18. The functional clothing article of claim 13, further comprising:

a waist support having hook units at opposite ends for attaching to the loop units of the at least two second elastic abdominal support panels.

19. The functional clothing article of claim 17, wherein when the waist support is attached, the waist support surrounds a portion of the waist region of the user.

20. The functional clothing article of claim 16, wherein when attached the opposite ends of the waist support are non-overlapping.

21. A functional clothing article comprising:

a body for receiving and supporting a hip region, an abdominal region and a waist region of a user;

an abdominal support unit provided at a front portion of the body and supporting the abdominal region of the user, the abdominal support unit having at least one first elastic abdominal support panel and at least two second elastic abdominal support panels, the at least two second elastic abdominal support panels having loop units for receiving opposite ends of a waist support, wherein the at least one first elastic abdominal support panel is arranged between the at least two second elastic abdominal support panels, the at least one first elastic abdominal support panel and the at least two second elastic abdominal support panels are positioned laterally about the waist region of the user, and the body is formed of a first material; and a waist support including, an inner portion including elastic bands and hook units, the hook units being arranged at opposing ends of the waist support, and the hook units being attachable to the functional clothing article such that the waist support surrounds a portion of the user's waist, and an outer portion covered by the first material, wherein the waist support is configured such that the hook units do not overlap when worn around the user's waist.

22. A waist support for attaching to a functional clothing article around the waist of a user, the functional clothing article having a body formed of a first material and an abdominal support unit including a first elastic abdominal support panel positioned between at least two second elastic abdominal support panels, wherein an elasticity of the at least two second elastic abdominal support panels is less than an elasticity of the first elastic abdominal support panel, and wherein the first elastic abdominal support panel and the at least two second elastic abdominal support panels are positioned laterally about the waist of the user, the waist support comprising:

an inner portion including elastic bands and hook units, the hook units being arranged at opposing ends of the waist support, and the hook units being adapted to be secured to the at least two second elastic abdominal support panels such that the waist support surrounds a portion of the user's waist; and an outer portion covered by the first material; wherein when the waist support is attached, opposing ends of the waist support do not overlap to provide non-overlapping support.

* * * * *